US010316619B2

(12) United States Patent
de Oliveira et al.

(10) Patent No.: US 10,316,619 B2
(45) Date of Patent: Jun. 11, 2019

(54) SYSTEMS AND METHODS FOR STAGE CEMENTING

(71) Applicant: Saudi Arabian Oil Company, Dhahran (SA)

(72) Inventors: Victor Carlos Costa de Oliveira, Dhahran (SA); Rodny Benjamin Masoud Zuleta, Dhahran (SA); Khaled K. Abouelnaaj, Dhahran (SA); Dean S. Porter, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 169 days.

(21) Appl. No.: 15/460,791

(22) Filed: Mar. 16, 2017

(65) Prior Publication Data

US 2018/0266208 A1 Sep. 20, 2018

(51) Int. Cl.
*E21B 33/14* (2006.01)
*E21B 34/14* (2006.01)
(Continued)

(52) U.S. Cl.
CPC ..... *E21B 33/146* (2013.01); *E21B 34/10* (2013.01); *E21B 34/14* (2013.01); *E21B 34/16* (2013.01);
(Continued)

(58) Field of Classification Search
CPC ..... E21B 33/146; E21B 34/14; E21B 34/16; E21B 34/10; E21B 47/122; E21B 2034/007; E21B 34/06
See application file for complete search history.

(56) References Cited

U.S. PATENT DOCUMENTS 1,812,044 A 6/1931 Grant
3,335,801 A 8/1967 Wilsey
(Continued)

FOREIGN PATENT DOCUMENTS

CN 204177988 2/2015
EP 377234 10/1989
(Continued)

OTHER PUBLICATIONS

Offshore, "Completions Technology: Large monobore completions prevent high-volume gas well flow restrictions", Dec. 1, 2001, retrieved from the internet: • http://www.offshore-mag.com/articles/print/volume-61/issue-12/news/completions-technology-large-monobore-completions-prevent-high-volume-gas-well-flow-restrictions.html, 9 pages.
(Continued)

*Primary Examiner* — Wei Wang
(74) *Attorney, Agent, or Firm* — Fish & Richardson P.C.

(57) ABSTRACT

A stage cementing tool includes a top sub-assembly; a bottom sub-assembly; a housing that connects the top and bottom sub-assembly and includes a bore therethrough from the top sub-assembly to the bottom sub-assembly, the housing including a plurality of ports radially arranged in the housing, each port including a fluid path between an interior radial surface of the housing and an outer radial surface of the housing; at least one sleeve that rides on a portion of the housing; and a controller mounted in the housing and configured to control the sleeve to adjust, based on receipt of a command to the controller from the terranean surface, between a first position such that the sleeve mandrel decouples fluid communication from the bore to an exterior of the housing through the fluid paths and a second position such that the sleeve mandrel fluidly couples the bore with the exterior of the housing through the fluid paths.

22 Claims, 5 Drawing Sheets

(51) Int. Cl.

| | |
|---|---|
| ***E21B 34/10*** | (2006.01) |
| ***E21B 34/16*** | (2006.01) |
| ***E21B 47/12*** | (2012.01) |
| ***E21B 34/00*** | (2006.01) |

(52) U.S. Cl.
CPC ..... *E21B 47/122* (2013.01); *E21B 2034/007* (2013.01)

(56) References Cited

U.S. PATENT DOCUMENTS 3,557,875 A 1/1971 Solum et al.
4,058,163 A 11/1977 Yandell
4,384,625 A 5/1983 Roper et al.
4,399,873 A 8/1983 Lindsey, Jr.
4,458,761 A 7/1984 Van Vreeswyk
4,482,014 A 11/1984 Allwin et al.
4,646,842 A 3/1987 Arnold et al.
4,674,569 A 6/1987 Revils et al.
4,681,159 A 7/1987 Allwin et al.
4,693,328 A 9/1987 Furse et al.
4,852,654 A 8/1989 Buckner
4,855,820 A 8/1989 Barbour
4,944,348 A 7/1990 Whiteley et al.
4,993,493 A 2/1991 Arnold
5,152,342 A 10/1992 Rankin et al.
5,390,742 A 2/1995 Dines et al.
5,947,213 A 9/1999 Angle
6,009,948 A 1/2000 Flanders et al.
RE36,556 E 2/2000 Smith
6,152,221 A 11/2000 Carmicheal et al.
6,163,257 A 12/2000 Tracy
6,234,250 B1 5/2001 Green et al.
6,378,628 B1 4/2002 McGuire et al.
6,527,066 B1 3/2003 Rives
6,550,534 B2 4/2003 Brett
6,577,244 B1 6/2003 Clark et al.
6,662,110 B1 12/2003 Bargach et al.
6,684,953 B2 2/2004 Sonnier
6,691,779 B1 2/2004 Sezginer et al.
6,739,398 B1 5/2004 Yokley et al.
6,752,216 B2 6/2004 Coon
6,873,267 B1 3/2005 Tubel et al.
6,899,178 B2 5/2005 Tubel
6,938,698 B2 9/2005 Coronado
7,219,730 B2 5/2007 Tilton et al.
7,228,902 B2 6/2007 Oppelt
7,243,735 B2 7/2007 Koederitz et al.
7,252,152 B2 8/2007 LoGiudice et al.
7,278,492 B2 10/2007 Braddick
7,419,001 B2 9/2008 Broussard
7,581,440 B2 9/2009 Meek
7,654,334 B2 2/2010 Manson
7,665,537 B2 2/2010 Patel et al.
7,677,303 B2 3/2010 Coronado
7,938,192 B2 5/2011 Rytlewski
7,940,302 B2 5/2011 Mehrotra et al.
8,028,767 B2 10/2011 Radford et al.
8,102,238 B2 1/2012 Golander et al.
8,191,635 B2 6/2012 Buske et al.
8,237,585 B2 8/2012 Zimmerman
8,334,775 B2 12/2012 Tapp et al.
8,424,605 B1 4/2013 Schultz et al.
8,448,724 B2 5/2013 Buske et al.
8,469,084 B2 6/2013 Clark et al.
8,528,668 B2 9/2013 Rasheed
8,540,035 B2 9/2013 Xu et al.
8,750,513 B2 6/2014 Renkis
8,789,585 B2 7/2014 Leising et al.
8,800,655 B1 8/2014 Bailey
8,833,472 B2 9/2014 Hay
8,919,431 B2 12/2014 Lott
8,925,213 B2 1/2015 Sallwasser
8,991,489 B2 3/2015 Redlinger et al.
9,051,792 B2 6/2015 Herberg et al.
9,091,148 B2 7/2015 Moffitt et al.
9,121,255 B2 9/2015 Themig et al.
9,140,100 B2 9/2015 Daccord et al.
9,157,294 B2 10/2015 Kleppa et al.
9,187,959 B2 11/2015 Treviranus et al.
9,208,676 B2 12/2015 Fadell et al.
9,341,027 B2 5/2016 Radford et al.
9,494,003 B1 11/2016 Carr
9,506,318 B1 11/2016 Brunet
9,546,536 B2 1/2017 Schultz et al.
2002/0148607 A1 10/2002 Pabst
2003/0001753 A1 1/2003 Cernocky et al.
2004/0060741 A1 4/2004 Shipalesky et al.
2004/0156264 A1 8/2004 Gardner et al.
2005/0273302 A1 12/2005 Huang et al.
2006/0081375 A1 4/2006 Ruttley
2006/0086497 A1 4/2006 Ohmer et al.
2006/0107061 A1 5/2006 Holovacs
2006/0260799 A1 11/2006 Broussard
2006/0290528 A1 12/2006 MacPherson et al.
2007/0057811 A1 3/2007 Mehta
2007/0107911 A1 5/2007 Miller et al.
2007/0187112 A1 8/2007 Eddison et al.
2007/0261855 A1 11/2007 Brunet
2008/0041631 A1 2/2008 Vail, III
2008/0115574 A1 5/2008 Meek
2009/0045974 A1 2/2009 Patel
2009/0050333 A1 2/2009 Smith
2009/0114448 A1 5/2009 Laird et al.
2009/0223670 A1 9/2009 Snider
2009/0289808 A1 11/2009 Prammer
2010/0097205 A1 4/2010 Script
2010/0101786 A1 4/2010 Lovell et al.
2010/0212891 A1 8/2010 Stewart et al.
2010/0212900 A1 8/2010 Eddison et al.
2010/0212901 A1 8/2010 Buytaert
2010/0258298 A1 10/2010 Lynde et al.
2010/0282511 A1 11/2010 Maranuk et al.
2011/0067884 A1 3/2011 Burleson et al.
2011/0073329 A1 3/2011 Clemens et al.
2011/0127044 A1 6/2011 Radford et al.
2011/0147014 A1 6/2011 Chen et al.
2011/0240302 A1 10/2011 Coludrovich, III
2011/0266004 A1 11/2011 Hallundbaek et al.
2012/0085540 A1 4/2012 Heijnen
2012/0175135 A1 7/2012 Dyer et al.
2012/0241154 A1 9/2012 Zhou
2012/0247767 A1 10/2012 Themig et al.
2012/0307051 A1 12/2012 Welter
2012/0312560 A1 12/2012 Bahr et al.
2013/0128697 A1 5/2013 Contant
2013/0153245 A1 6/2013 Knobloch et al.
2014/0060844 A1 3/2014 Barbour et al.
2014/0083769 A1 3/2014 Moriarty et al.
2014/0090898 A1 4/2014 Moriarty et al.
2014/0126330 A1 5/2014 Shampine et al.
2014/0139681 A1 5/2014 Jones, Jr. et al.
2014/0166367 A1 6/2014 Campbell et al.
2014/0172306 A1 6/2014 Brannigan
2014/0208847 A1 7/2014 Baranov
2014/0308203 A1 10/2014 Sheinberg et al.
2015/0027706 A1 1/2015 Symms
2015/0090459 A1 4/2015 Cain et al.
2015/0152713 A1 6/2015 Garcia et al.
2015/0176362 A1 6/2015 Prieto et al.
2015/0267500 A1 9/2015 Van Dongen et al.
2015/0308203 A1 10/2015 Lewis
2016/0160578 A1 6/2016 Lee
2016/0215612 A1 7/2016 Morrow
2016/0230508 A1 8/2016 Jensen
2016/0237764 A1 8/2016 Jellison et al.
2016/0237768 A1 8/2016 Jamison et al.
2016/0356152 A1 12/2016 Croux
2017/0074071 A1 3/2017 Tzallas et al.
2018/0030810 A1 2/2018 Saldanha

(56) References Cited

U.S. PATENT DOCUMENTS

FOREIGN PATENT DOCUMENTS

| | | |
|---|---|---|
| EP | 618345 | 10/1994 |
| EP | 2692982 | 5/2014 |
| EP | 2835493 | 2/2015 |
| GB | 2157743 | 10/1985 |
| GB | 2261238 | 12/1993 |
| GB | 2460096 | 11/2009 |
| GB | 2470762 | 12/2010 |
| WO | 2003058545 | 7/2003 |
| WO | 2011038170 | 3/2011 |
| WO | 2011095600 | 8/2011 |
| WO | 2011159890 | 12/2011 |

OTHER PUBLICATIONS

Engineers Edge—ACME Stub Threads Size Designation Table Chart, retrieved from the internet at: http://www.engineersedge.com/hardware/acme-stub-thread.htm, retrieved Feb. 27, 2017, 2 pages.

Engineering Innovation Worldwide, TIW XPAK Liner Hanger System brochure, 2015 TIW Corporation, Houston TX , TIW0001D Jun. 2015, retrieved form the internet at: http://www.tiwoiltools.com/Images/Interior/downloads/tiw_xpak_brochure.pdf, 4 pages.

Mi Swaco: A Schlumberger Company, "Intelligent Fluids Monitoring System," available on or before Mar. 11, 2015, [retrieved May 1, 2018] retrieved from URL: <https://www.slb.com/resources/other_resources/brochures/miswaco/intelligent_fluids_monitoring_brochure.aspx>, 8 pages.

International Search Report and Written Opinion issued in International Application No. PCT/US2018/022202 dated Jun. 8, 2018, 13 pages.

SYSTEMS AND METHODS FOR STAGE CEMENTING

TECHNICAL FIELD

The present disclosure relates to apparatus, systems, and methods for stage cementing and, more particularly, stage cementing of a casing string in a wellbore.

BACKGROUND

Stage-cementing tools, or differential valve (DV) tools, are used to cement casing sections behind the same casing string, or to cement a critical long section in multiple stages. Stage cementing may reduce mud contamination and lessens the possibility of high filtrate loss or formation breakdown caused by high hydrostatic pressures, which is often a cause for lost circulation. In a multi-stage cementing process, a first (or bottom) cement stage is pumped through a cementing tool to the end of the casing and up an annulus to a calculated-fill volume (e.g., height). Then, a shutoff or bypass plug can be dropped or pumped in the casing to seal the first stage. Next, a free-fall or pump-down plug may be used to hydraulically set and open the stage tool (e.g., lower most in the case multiple stage tools are used), allowing the second (or top) cement stage to be displaced above the stage tool (e.g., lower most in the case multiple stage tools are used). A closing plug is then pumped down to close the stage tool (e.g., lower most in the case multiple stage tools are used) to keep cement from U-tubing above and back through the tool. In the event an additional (upper) stage tool is used, the above process repeats itself with the exception that only a free fall plug is used to hydraulically set and open the stage tool, allowing for the third cement stage to be displaced above the upper stage tool. Often, stage cementing tools do not open or close properly when using pumped or dropped plugs. Further, there may be leakages of cement around the plugs and through the stage tools.

SUMMARY

In an example implementation, a stage cementing tool includes a top sub-assembly configured to couple to a portion of a casing string; a bottom sub-assembly configured to couple to another portion of the casing string; a housing that connects the top and bottom sub-assembly and includes a bore therethrough from the top sub-assembly to the bottom sub-assembly, the housing including a plurality of ports radially arranged in the housing, each port including a fluid path between an interior radial surface of the housing and an outer radial surface of the housing; at least one sleeve that rides on a portion of the housing; and a controller mounted in the housing and configured to control the sleeve to adjust, based on receipt of a command to the controller from the terranean surface, between a first position such that the sleeve mandrel decouples fluid communication from the bore to an exterior of the housing through the fluid paths and a second position such that the sleeve mandrel fluidly couples the bore with the exterior of the housing through the fluid paths.

An aspect combinable with the example implementation further includes a hydraulic power unit communicably coupled to the controller and configured to adjust the sleeve between the first and second positions.

In another aspect combinable with any of the previous aspects, the at least one sleeve includes a plurality of sleeves, each sleeve associated with one of the plurality of ports.

In another aspect combinable with any of the previous aspects the hydraulic power unit includes a plurality of hydraulic fluid cavities, each cavity aligned with one of the plurality of ports and at least partially filled with a hydraulic fluid; and at least one pump fluidly coupled to the hydraulic fluid cavities to circulate the hydraulic fluid in each hydraulic fluid cavity against a respective sleeve.

In another aspect combinable with any of the previous aspects, the controller is communicably coupled to the pump and operable to activate the pump to circulate the hydraulic fluid into a plurality of slots and against the plurality of sleeves to move the sleeves on the housing within respective slots to align a bore of each sleeve with the port in the second position.

Another aspect combinable with any of the previous aspects further includes a plurality of biasing members.

In another aspect combinable with any of the previous aspects, each biasing member is mounted in the housing adjacent a respective sleeve.

In another aspect combinable with any of the previous aspects, the controller is communicably coupled to the pump and operable to deactivate the pump to allow the hydraulic fluid to flow into the hydraulic fluid cavities, and each biasing member is configured to urge the respective sleeve on the housing to misalign the bore of each sleeve with the port in the first position.

Another aspect combinable with any of the previous aspects further includes a plurality of valves.

In another aspect combinable with any of the previous aspects, each valve is fluidly coupled between a respective hydraulic fluid cavity and a respective slot.

Another aspect combinable with any of the previous aspects further includes at least one pressure sensor mounted in the housing to detect a fluid pressure of the hydraulic fluid, the at least one pressure sensor communicably coupled to the controller.

In another aspect combinable with any of the previous aspects, the controller includes a wireless transceiver configured to communicate with a stage cementing control system at the terranean surface.

In another example implementation, a method for cementing a casing in a wellbore includes receiving, at a stage cementing tool coupled within a casing string in a wellbore, a wireless command from a stage cementing control system at a terranean surface; based on the wireless command, operating a hydraulic power unit mounted in a housing of the stage cementing tool to pressurize a hydraulic fluid stored in a hydraulic fluid cavity of the housing; urging, with the pressurized hydraulic fluid, at least one sleeve positioned to ride on a portion of the housing from a first position to a second position; based on urging of the at least one sleeve from the first position to the second position, fluidly coupling a bore of the housing defined by an inner radial surface of the housing to an annulus of the wellbore adjacent an outer radial surface of the housing; and circulating a flow of cement from the bore, through at least one port defined in the housing between the inner and outer radial surfaces, and to the annulus.

Another aspect combinable with any of the previous aspects further includes receiving, at the stage cementing tool, another wireless command from the stage cementing control system at the terranean surface; based on the other wireless command, operating the hydraulic power unit to depressurize the hydraulic fluid; urging, with a biasing member mounted in the housing, the at least one sleeve from the second position to the first position; based on urging of the at least one sleeve from the second position to the first position, fluidly decoupling the bore of the housing with the annulus; and stopping the flow of cement, with the sleeve, through the port defined in the housing between the inner and outer radial surfaces.

In another aspect combinable with any of the previous aspects, the at least one sleeve includes a plurality of sleeves, each sleeve associated with one of a plurality of ports.

Another aspect combinable with any of the previous aspects further includes operating the hydraulic power unit to pressurize the hydraulic fluid stored in a plurality of hydraulic fluid cavities of the housing; urging, with the pressurized hydraulic fluid in each hydraulic fluid cavity, a respective sleeve of the plurality of sleeves from the first position to the second position; and based on urging each of the sleeves from the first position to the second position, fluidly coupling the bore of the housing to the annulus of the wellbore adjacent the outer radial surface of the housing through a respective port of a plurality of ports in the housing In another aspect combinable with any of the previous aspects, operating the hydraulic power unit to pressurize the hydraulic fluid stored in the plurality of hydraulic fluid cavities of the housing includes operating at least one pump to pressurize the hydraulic fluid in the plurality of hydraulic fluid cavities; and circulating the pressurized hydraulic fluid into a plurality of slots and against the plurality of sleeves to move the sleeves on the housing within respective slots to align a bore of each sleeve with the port to adjust the sleeves to the second position.

In another aspect combinable with any of the previous aspects, operating the hydraulic power unit to depressurize the hydraulic fluid includes deactivating at least one pump in fluid communication with the hydraulic fluid cavity; an allowing the pressurized hydraulic fluid to flow back into the hydraulic fluid cavity.

Another aspect combinable with any of the previous aspects further includes wirelessly transmitting, from the stage cementing tool to the stage cementing control system, data associated with operation of the stage cementing tool to the stage cementing control system.

In another aspect combinable with any of the previous aspects, the data includes at least one of a power status of the stage cementing tool, a sensed pressure of the hydraulic fluid, or an electronic status of the stage cementing tool.

Another aspect combinable with any of the previous aspects further includes supplying power to at least one of a controller or the power unit of the stage cementing tool with a battery mounted in the housing.

In another aspect combinable with any of the previous aspects, the stage cementing tool includes a first stage cementing tool.

In another aspect combinable with any of the previous aspects further includes, subsequent to stopping the flow of cement with the sleeve through the port defined in the housing between the inner and outer radial surfaces, receiving, at a second stage cementing tool coupled within the casing string in the wellbore, another wireless command from the stage cementing control system at the terranean surface; based on the other wireless command, operating a hydraulic power unit mounted in a housing of the second stage cementing tool to pressurize a hydraulic fluid stored in a hydraulic fluid cavity of the housing; urging, with the pressurized hydraulic fluid, at least one sleeve positioned to ride on a portion of the housing from a first position to a second position; based on urging of the at least one sleeve from the first position to the second position, fluidly coupling a bore of the housing defined by an inner radial surface of the housing to the annulus of the wellbore adjacent an outer radial surface of the housing; and circulating another flow of cement from the bore, through at least one port defined in the housing between the inner and outer radial surfaces, and to the annulus.

In another example implementation, a stage cementing system includes a stage cementing control system positioned on a terranean surface and configured for wireless communication; and a first stage cementing tool configured to couple within a production casing string in a wellbore. The first stage cementing tool includes a housing that includes a bore therethrough; a plurality of ports radially about the housing, each port including a flow path between the bore and an outer radial surface of the housing; a plurality of sleeve mandrels, each sleeve mandrel positioned to ride the housing to orthogonally intersect a respective port of the plurality of ports; and a controller mounted in the housing and configured for wireless communication with the stage cementing control system. The controller is configured to perform operations including: receiving a first wireless signal from the stage cementing control system; and based on the first wireless signal, operating a hydraulic power unit of the first stage cementing tool to circulate a pressurized fluid against the sleeve mandrels to urge each of the sleeve mandrels into a clearance position out of a respective port of the plurality of ports to fluidly couple the bore with an annulus of the wellbore during a first cementing operation.

In an aspect combinable with the example implementation, the controller is further configured to perform operations including receiving a second wireless signal from the cementing control system; and based on the second wireless signal, operating the hydraulic power unit to depressurize the pressurized fluid against the sleeve mandrels.

In another aspect combinable with any of the previous aspects, the stage cementing tool further includes a plurality of springs, each spring positioned to urge a respective sleeve mandrel in a direction opposite a flow of the pressurized fluid to fluidly decouple the bore with the annulus of the wellbore during the first cementing operation.

Another aspect combinable with any of the previous aspects further includes a second stage cementing tool configured to couple within the production casing string in the wellbore.

In another aspect combinable with any of the previous aspects, the second stage cementing tool includes a housing that includes a bore therethrough; a plurality of ports radially about the housing, each port including a flow path between the bore and an outer radial surface of the housing; a plurality of sleeve mandrels, each sleeve mandrel positioned to ride the housing to orthogonally intersect a respective port of the plurality of ports; and a controller mounted in the housing and configured for wireless communication with the stage cementing control system. The controller of the second stage cementing tool is configured to perform operations including: receiving a third wireless signal from the stage cementing control system; and based on the third wireless signal, operating a hydraulic power unit of the second stage cementing tool to circulate a pressurized fluid against the sleeve mandrels to urge each of the sleeve mandrels into a clearance position out of a respective port of the plurality of ports to fluidly couple the bore with the annulus of the wellbore during a second cementing operation.

Implementations according to the present disclosure may include one or more of the following features. For example, a stage cementing tool according to the present disclosure may be wirelessly operated (e.g., by Wi-Fi transmission or electromagnetics) while positioned on a production casing in a wellbore. As another example, a stage cementing tool according to the present disclosure may be activated (e.g., opened) and deactivated (e.g., closed) multiple times within a cementing operation. A stage cementing tool according to the present disclosure may also provide real-time diagnostic information (e.g., about a state of the tool, about a state of a cementing operation) to a control system for the cementing operation. As another example, a stage cementing tool according to the present disclosure may operate to circulate cement to an annulus between a casing and a wellbore without opening or closing plugs or making clean-out runs. As yet another example, a stage cementing tool according to the present disclosure may be part of a system which includes multiple, independently operable stage cementing tools positioned in a casing string. Further, a stage cementing tool according to the present disclosure may eliminate or help eliminate costs and mechanical failures associated with plug operated tools that often result in additional trips, time delays and potential remedial cementing operations.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

The present disclosure describes a stage cementing tool and system for a cementing process to set a casing into a wellbore. In some aspects, the stage cementing tool may be wirelessly activated by a surface control system to open one or more ports in the tool to fluidly connect the casing with an annulus of the wellbore. Cement may be circulated through the one or more ports and into the annulus to set the casing in the wellbore. In some aspects, there may be multiple stage cementing tools coupled within the casing string. Each stage cementing tool may be serially activated (e.g., one or more times) to open, allowing cement, or other fluids, to flow into the annulus, as well as serially deactivated (e.g., one or more times) to close.

Figure 1:
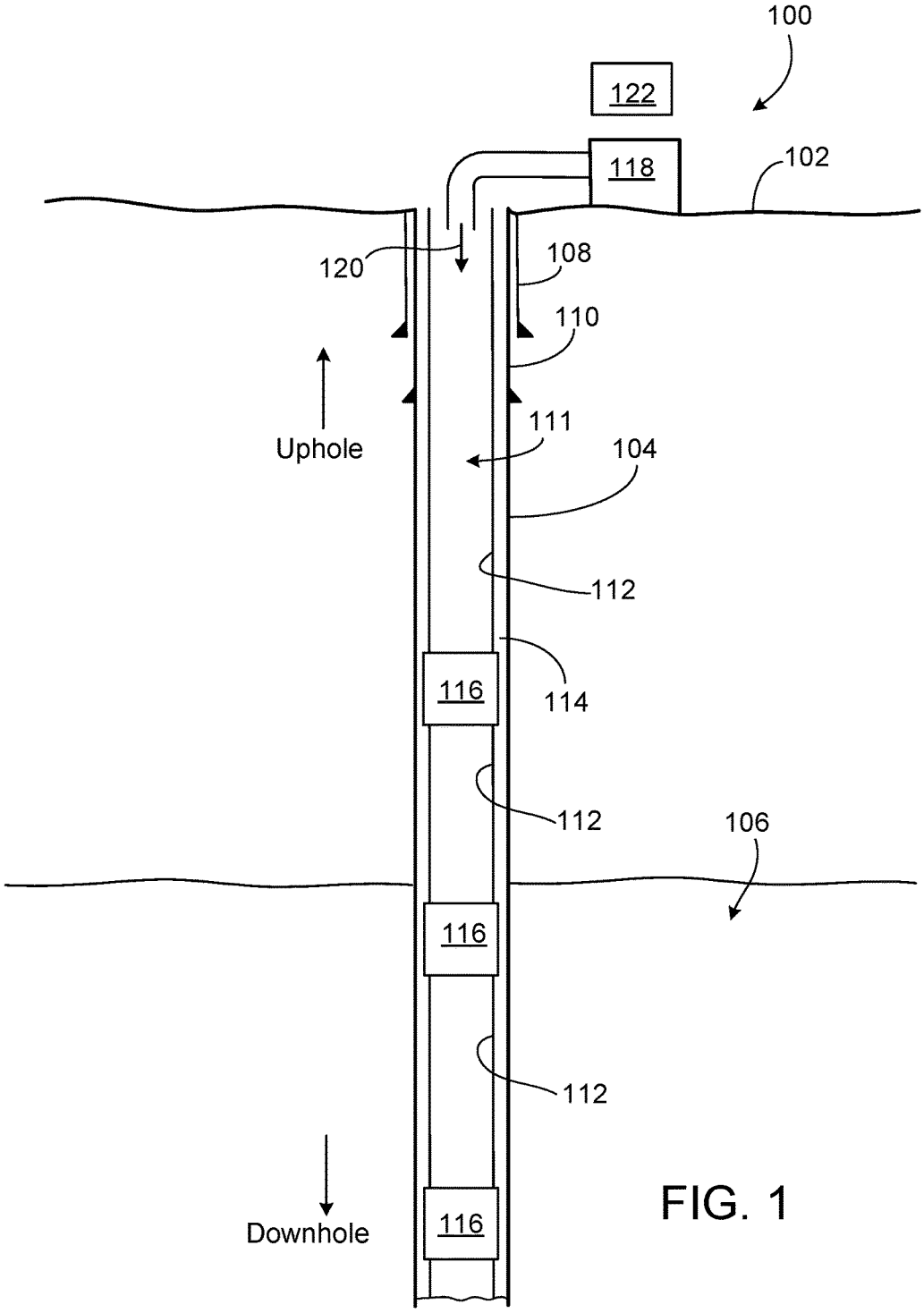
FIG. 1 is a schematic illustration of an example implementation of a stage cementing system according to the present disclosure.

FIG. 1 is a schematic illustration of an example implementation of a stage cementing system 100. As shown in FIG. 1, a wellbore 104 is formed from a terranean surface 102 to one or more subterranean zones 106. Although shown as a wellbore 104 that extends from land, the wellbore 104 may be formed under a body of water rather than the terranean surface 102. For instance, in some embodiments, the terranean surface 102 may be an ocean, gulf, sea, or any other body of water under which hydrocarbon-bearing, or water-bearing, formations may be found. In short, reference to the terranean surface 102 includes both land and water surfaces and contemplates forming and/or developing one or more wellbores 104 from either or both locations.

Generally, the wellbore 104 may be formed by any appropriate assembly or drilling rig used to form wellbores or boreholes in the Earth. A drilling assembly may use traditional techniques to form such wellbores or may use nontraditional or novel techniques. In some embodiments, a drilling assembly may use rotary drilling equipment to form such wellbores. Although shown as a substantially vertical wellbore (e.g., accounting for drilling imperfections), the wellbore 104, in alternative aspects, may be directional, horizontal, curved, multi-lateral, or other form other than merely vertical.

Once the wellbore 104 is formed (or in some cases during portions of forming the wellbore 104), one or more tubular casings may be installed in the wellbore 104. As illustrated, the wellbore 104 includes a conductor casing 108, which extends from the terranean surface 102 shortly into the Earth. A portion of the wellbore portion 104 enclosed by the conductor casing 108 may be a large diameter borehole.

Downhole of the conductor casing 108 may be the surface casing 110. The surface casing 110 may enclose a slightly smaller borehole and protect the wellbore 104 from intrusion of, for example, freshwater aquifers located near the terranean surface 102. Downhole of the surface casing 110 (or, in some aspects, an additional intermediate casing), is a production casing 111, that is formed of production casing joints 112 (or casing joints 112). Generally, each casing joint 112 is a tubular that may be coupled (e.g., threadingly) to another casing joint 112, or as shown in FIG. 1, a stage cementing tool 116 according to the present disclosure. The production casing 111, generally, may be installed adjacent or across a hydrocarbon bearing reservoir, e.g., subterranean zone 106. Completion components, such as perforating, hydraulic fracturing, acidizing, artificial lift components, are subsequently installed within the production casing 111 to produce hydrocarbons from the subterranean zone 106 to the terranean surface 102.

In the illustrated implementation, the production casing 111 (and other casings shown herein) may be installed, or set, in the wellbore 104 with cement (or other hardenable substance capable of setting the casing 111 in the wellbore 104. For example, cement 120 may be circulated from surface cementing equipment 118 into the production casing 111 from the terranean surface, through one or more of the stage cementing tools 116 installed in the production casing 111 (or other casings, such as an intermediate casing), and into an annulus 114 between the casing 111 and the wellbore 104. Once the cement 120 fills the annulus 114 and hardens, the production casing 111 (and other casings) may be set into the wellbore 104, thereby allowing completion operations to commence.

The schematic representation of the surface cementing equipment 118 includes, for example, one or more pumps, valves, and conduits that are fluidly coupled to a source of cement, such as cement mixed and/or stored in one or more tanks of the system 118. The surface cementing equipment 118 also includes or is communicably coupled to a stage cementing control system 122 (e.g., which is communicably coupled to control the one or more pumps and one or more valves of the system 118). Generally, the stage cementing control system 122 may include a processor or microprocessor, hydraulic, pneumatic, mechanical, electro-mechanical, or electric (or combination thereof) control system operable to communicate with the stage cementing tools 116

(e.g., wirelessly) to send commands to and receive data from the stage cementing tools 116 to initiate, execute, and complete a stage cementing operation to set the production casing 111 into the wellbore 104 with the cement 120.

In this example implementation, each of the stage cementing tools 116 (as described in more detail with reference to FIGS. 2A-2C) may wirelessly communicate with the stage cementing control system 122 to receive commands from, and send feedback data to, the control system 122. For example, in some aspects, the tools 116 may wirelessly (e.g., through Wi-Fi, electromagnetics, or other wireless communication) communicate with the stage cementing control system 122 to receive commands to open (e.g., to allow the cement 120 to flow from the production casing 111 into the annulus 114) or to close (e.g., to stop the cement 120 from flowing from the production casing 111 into the annulus 114). In some aspects, each of the stage cementing tools 116 may send (e.g., wirelessly) data associated with, for example, the operation or state (e.g., open or closed) of the tool 116 to the stage cementing control system 122.

The example system 100 may perform a cementing operation to set the production casing 111 (and/or other casings) into the wellbore 104 in two or more stages. For example, each "stage" may include flowing the cement 120 into the casing 111, through at least one of the stage cementing tools 116, and into the annulus 114 to fill a portion of the annulus 114 (less than the full annulus 114) with cement 120. For example, a first stage of the cementing operation may include circulating a portion of cement 120 through a downhole-most stage cementing tool 116 (e.g., the tool 116 closest downhole to the true vertical depth of the wellbore 104) and filling the annulus 114 between the downhole-most stage cementing tool 116 and the next most-downhole stage cementing tool 116. A second stage of the cementing operation may include circulating another portion of cement 120 through the next most-downhole cementing tool 116 and filling the annulus 114 between the next-most downhole stage cementing tool 116 and the stage cementing tool 116 that is uphole of the next-most downhole stage cementing tool 116. Additional stages can be completed to fill (e.g., all or substantially) the annulus 114 with cement 120.

In some aspects, each stage cementing tool 116 may be a stand-alone (e.g., not physically coupled or attached to the stage cementing control system 122) downhole tool operable to open, or close, one or more ports of the tool to circulate a flow, or stop a flow, of the cement 120 from the production casing 111 into the annulus 114. For example, each stage cementing tool 116 may be individually and independently activated (e.g., by the stage cementing control system 122) multiple times during a cementing operation without mechanical intervention, hydraulic intervention, or both (e.g., in order to activate). For instance, each stage cementing tool 116 may be activated and deactivated by wireless signals rather than, e.g., differential pressure, a setting tool, a plug, a pumped-in or dropped dart, or other mechanical or hydraulic tool. In addition, each stage cementing tool 116 may wirelessly communicate data (e.g., state of the tool, state of the cementing operation, diagnostic information of the tool, and otherwise) to the stage cementing control system 122. As such, the stage cementing tool 116 may monitor the integrity of the entire stage cementing system in real-time (e.g., during execution of the stage cementing operation) and eliminate the use of plug activation, which can become damaged get stuck inside the casing string prior to it arriving at a proper landing spot.

Figure 2A:
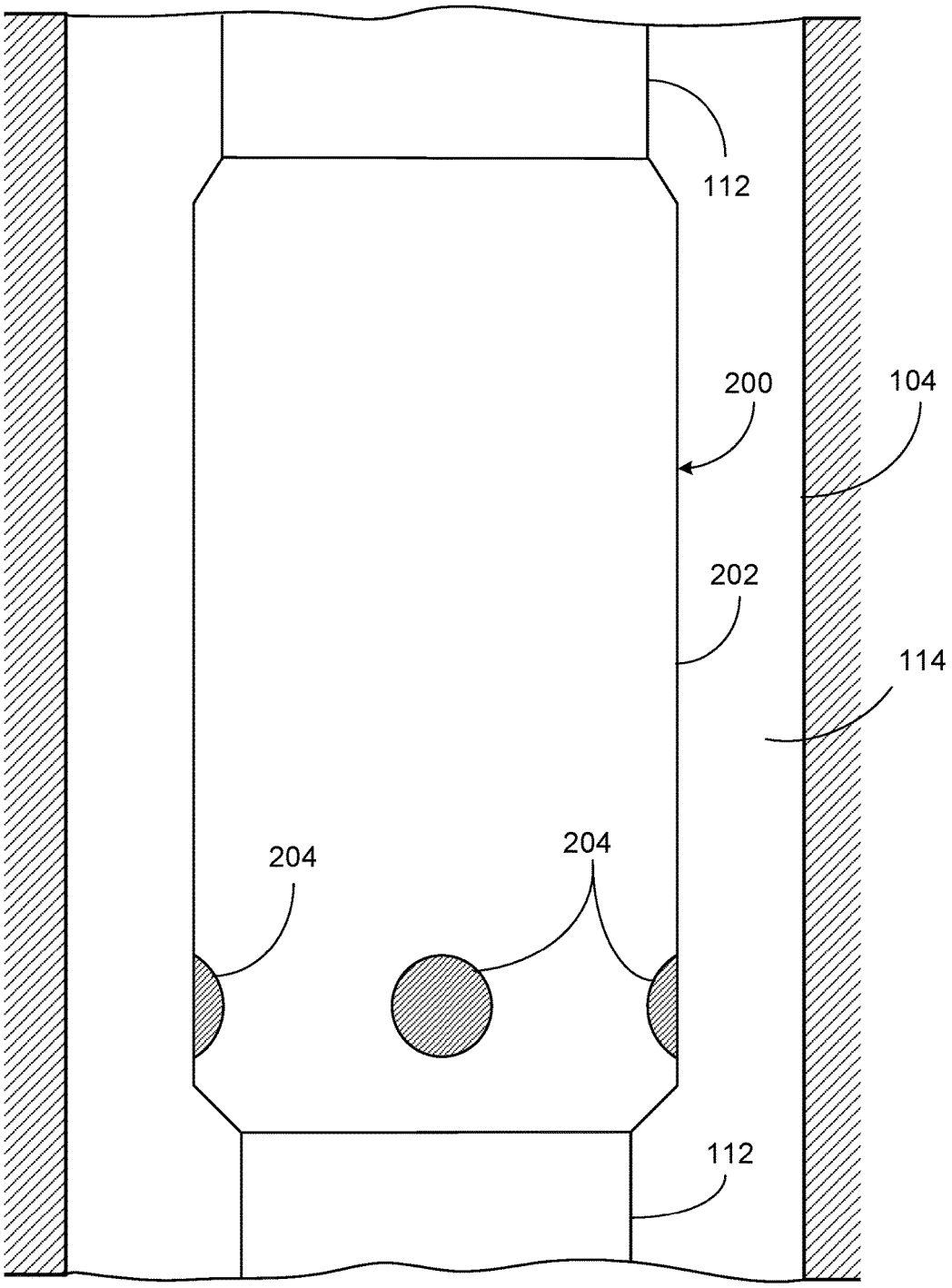
FIG. 2A is a schematic illustration of an example implementation of a stage cementing tool for a stage cementing system according to the present disclosure.
Figure 2B:
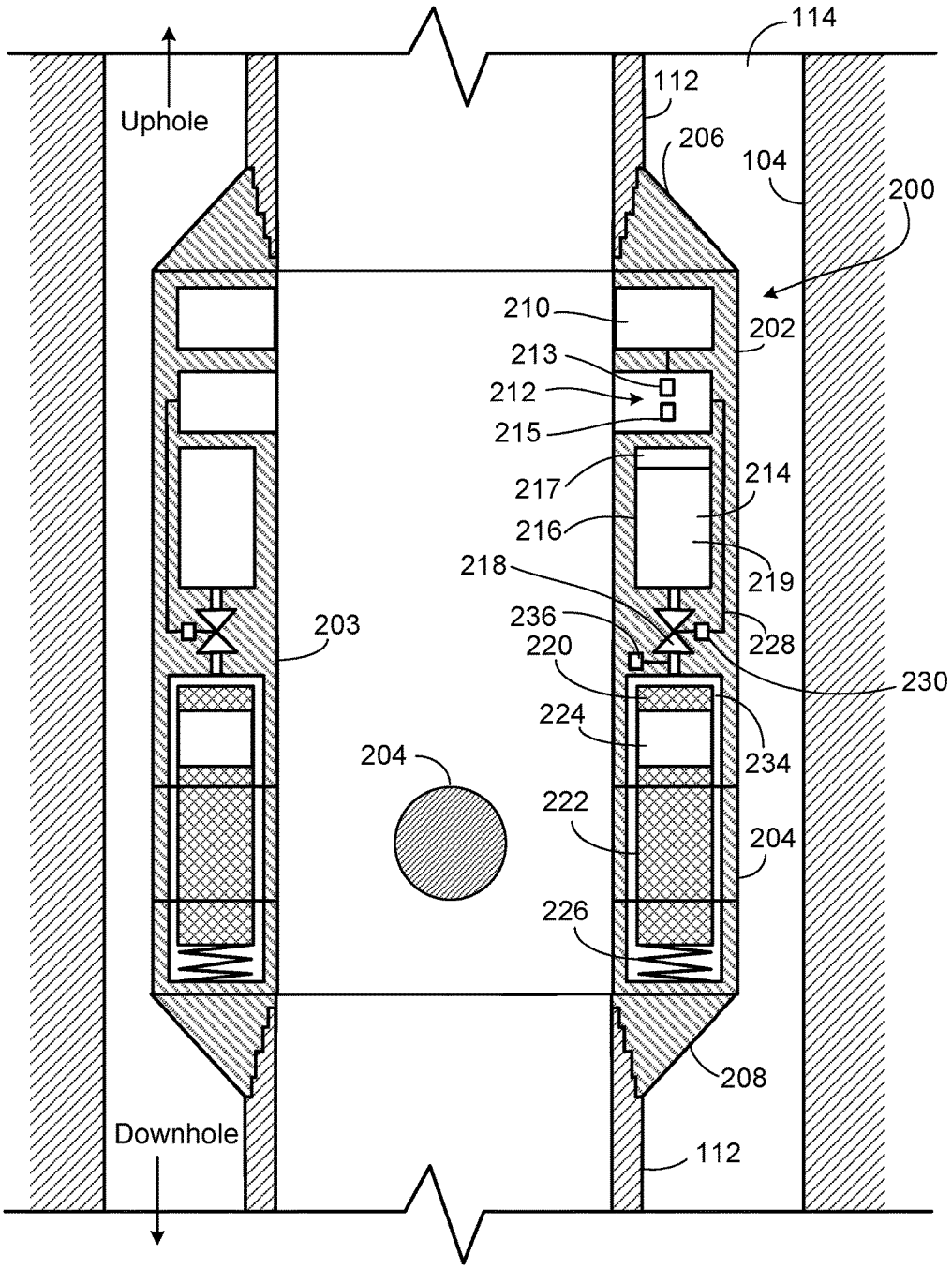
FIG. 2B is a schematic cross-sectional view of the example implementation of the stage cementing tool in a closed position according to the present disclosure.
Figure 2C:
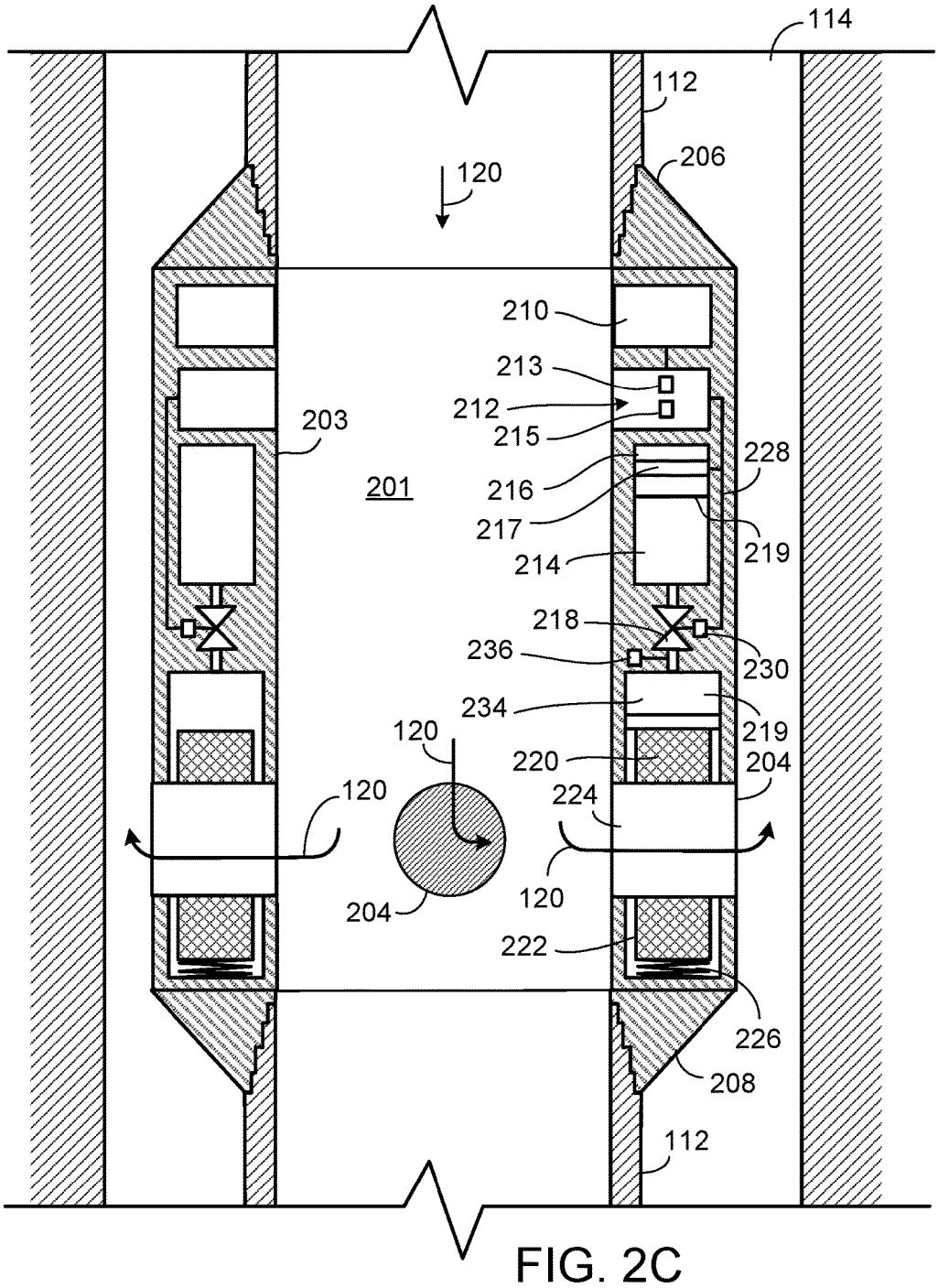
FIG. 2C is a schematic cross-sectional view of the example implementation of the stage cementing tool in an open position according to the present disclosure.

FIGS. 2A-2C are schematic illustrations of an example implementation of a stage cementing tool 200 for a stage cementing system. For example, in some aspects, the stage cementing tool 200 may be used in the stage cementing system 100 as stage cementing tool 116. FIG. 2A is a schematic illustration of the stage cementing tool 200 positioned in the wellbore 104 and coupled between casing joints 112. FIG. 2B is a schematic cross-sectional view of the stage cementing tool 200 positioned in the wellbore 104 and in a closed position. FIG. 2C is a schematic cross-sectional view of the stage cementing tool 200 positioned in the wellbore 104 and in an open position.

The illustrated implementation of the stage cementing tool 200 includes a housing 202 that couples to the casing joints 112 (at a top, or uphole, end of the tool 200 and a bottom, or downhole, end of the tool 200). As shown in FIGS. 2B-2C, a top sub-assembly 206 of the housing 202 couples (e.g., threadingly) to a casing joint 112, and a bottom sub-assembly 208 couples (e.g., threadingly) to another casing joint 112. An inner radial surface 203 of the housing 202 defines a bore 201 that extends through the stage cementing tool 200, which is aligned with bores of the casing joints 112 as illustrated. An outer radial surface 204 of the stage cementing tool 200 is positioned, when the stage cementing tool 200 is coupled to the casing joints 112, in the annulus 114.

As illustrated, multiple ports 204 extend through the housing 202 between the inner radial surface 203 and the outer radial surface 204. In this example implementation, there are four ports 204 that are radially arranged at 90° intervals around the housing 202. Each port 204 may provide a fluid pathway (closeable) between the bore 201 and annulus 114, e.g., to facilitate a flow of the cement 120 from the bore 201 to the annulus 114. In alternative implementations, there may be more or fewer ports 204, and each port 204 may have a circular or non-circular cross section.

As shown in FIGS. 2B-2C, the housing 202 of the stage cementing tool 200 encloses actuation components that facilitate activation of the stage cementing tool 200 (e.g., from a closed position to an open position). For example, a controller 212 that includes one or more processors 215 and at least one wireless transceiver 213 is enclosed within the housing 202. The controller 212, for example, comprises an interface between the stage cementing tool 200 and the stage cementing control system 122, or other control system for the cementing operation located at the terranean surface 102. The controller 212, utilizing the one or more processors 215, the wireless transceiver 213, and memory (e.g., as part of the stage cementing control system 122), may also manage communications between the stage cementing tool 200 and the stage cementing control system 122. The processor(s) 215, for instance, may process information from the tool 200 and the terranean surface 102, deliver diagnostic data of the stage cementing tool 200 (and functionality) in real time, identifying if any failure has occurred with the stage cementing tool 200 during a cementing operation or otherwise. The communication between the processor(s) 215 and the terranean surface 102 is facilitated through and with the transceiver 213 with wireless communication.

Electrical power is provided to the controller 212 by a power source 210 (e.g., battery). In some aspects, the power source 210 is a lithium battery that is electrically coupled to the controller 212, as well as a hydraulic power unit 216. The controller 212 may also be communicably coupled to the power source 210, e.g., to determine or receive a level or life of the power source 210.

As shown in FIGS. 2B-2C, each port 204 is associated with a respective power unit 216 that operates, for instance, to block or unblock the port 204 to fluidly couple or fluidly decouple the bore 201 from the annulus 114 through the respective port 204. In this example implementation, the hydraulic power unit 216 includes, for each respective port 204, a hydraulic fluid reservoir 214 that encloses a fluid, a valve 218 fluidly coupled to the reservoir 214, and a sleeve mandrel 220 that is positioned to move within a fluid cavity 234 to block (or unblock) the port 204. As shown, the sleeve mandrel 220 includes a bore 224 therethrough, as well as a block 222 (e.g., a solid portion) that is downhole of the bore 220.

As illustrated in this example, a biasing member 226 (e.g., spring, Bellville washers) is positioned in the fluid cavity 234 at a bottom end of the cavity 234. The biasing member 226, in some aspects, may be a compression spring that exerts a particular spring force sufficient to urge the sleeve mandrel 220 in an uphole direction (e.g., toward the valve 218) based on a pressure balance between the fluid 219 circulated into the fluid cavity 234 and the spring force.

In an example operation to activate the stage cementing tool 200 into an open position, as shown in FIG. 2B, first, the controller 212 may obtain or receive a command, through the transceiver 213, from the stage cementing control system 122 at the terranean surface 102 to activate. Next, the one or more processors 215 analyze the command and, determining that the command is to activate the stage cementing tool 200, the processor(s) 215 send a command to the power unit 216 (e.g., via a wired control 228). For example, the processor(s) 215 may send a signal to a pump 217 in the hydraulic power unit 216 to pressurize the fluid 219 in the reservoir 214. In some aspects, the processor(s) 215 may also command an actuator 230 of the valve 218 to open upon activation of the pump 217, thereby allowing the pump 217 to transfer the fluid 219 from the reservoir 214 into the fluid cavity 234. As the fluid 219 flows into the fluid cavity 234, the pressurized fluid is at or increases to a pressure on the sleeve mandrel 220 that is greater than the spring force of the biasing member 226, and the sleeve mandrel 220 is urged in a downhole direction. As the bore 224 of the sleeve mandrel 220 aligns with the port 204 (and the block 222 is moved downhole of the port 204 and misaligned with the port 204), fluid (e.g., cement) communication is established between the bore 201 and the annulus 114. In some aspects, the processor(s) 215 may close the valve 218 (e.g., through the actuator 230), to hold the fluid 219 in the fluid cavity 234 at a pressure above the spring force of the biasing member 226.

Upon opening of the ports 204, the power unit 216 may provide a status (e.g., "open") to the processor(s) 215. In some aspects, a pressure sensor 236 positioned to measure a pressure of the fluid 219 may send the measured pressure to the processor(s) 215. The processor(s) 215 may then send the status data, pressure data, and other data (e.g., battery life) to the stage cementing control system 122 through the transceiver 113. Thus, the stage cementing control system 122 may receive confirmation that the stage cementing tool 200 is open and able to facilitate a flow of the cement 120 to the annulus 114.

In an example operation to deactivate the stage cementing tool 200 to a closed position, as shown in FIG. 2C, first, the controller 212 may obtain or receive a command, through the transceiver 213, from the stage cementing control system 122 at the terranean surface 102 to deactivate. Next, the one or more processors 215 analyze the command and, determining that the command is to deactivate the stage cementing tool 200, the processor(s) 215 send a command to the power unit 216 (e.g., via a wired control 228). For example, the processor(s) 215 may send a signal to the pump 217 in the hydraulic power unit 216 to depressurize the fluid 219 (e.g., stop pumping), thereby allowing the fluid 219 to flow from the fluid cavity 234 back into the reservoir 214. In some aspects, the processor(s) 215 may also command the actuator 230 of the valve 218 to open upon or prior to deactivation of the pump 217, thereby allowing the fluid 219 to flow back into the reservoir 214 from the fluid cavity 234. As the fluid 219 flows from the fluid cavity 234, the pressure exerted onto the sleeve mandrel 220 by the pressurized fluid 219 decreases, until it is less than the spring force of the biasing member 226. The sleeve mandrel 220 is urged in an uphole direction by the biasing member 226. As the bore 224 of the sleeve mandrel 220 misaligns with the port 204, and the block 222 is aligned with the port 204, fluid (e.g., cement) communication is stopped between the bore 201 and the annulus 114. In some aspects, the block 222 of the sleeve mandrel 220, when aligned with the port 204, creates a fluid seal between the sleeve mandrel 220 and the port 204.

Upon closing of the ports 204, the power unit 216 may provide a status (e.g., "closed") to the processor(s) 215. In some aspects, the processor(s) 215 may also provide status data, pressure data, and other data (e.g., battery life) to the stage cementing control system 122 through the transceiver 113. Thus, the stage cementing control system 122 may receive confirmation that the stage cementing tool 200 is closed.

Figure 3:
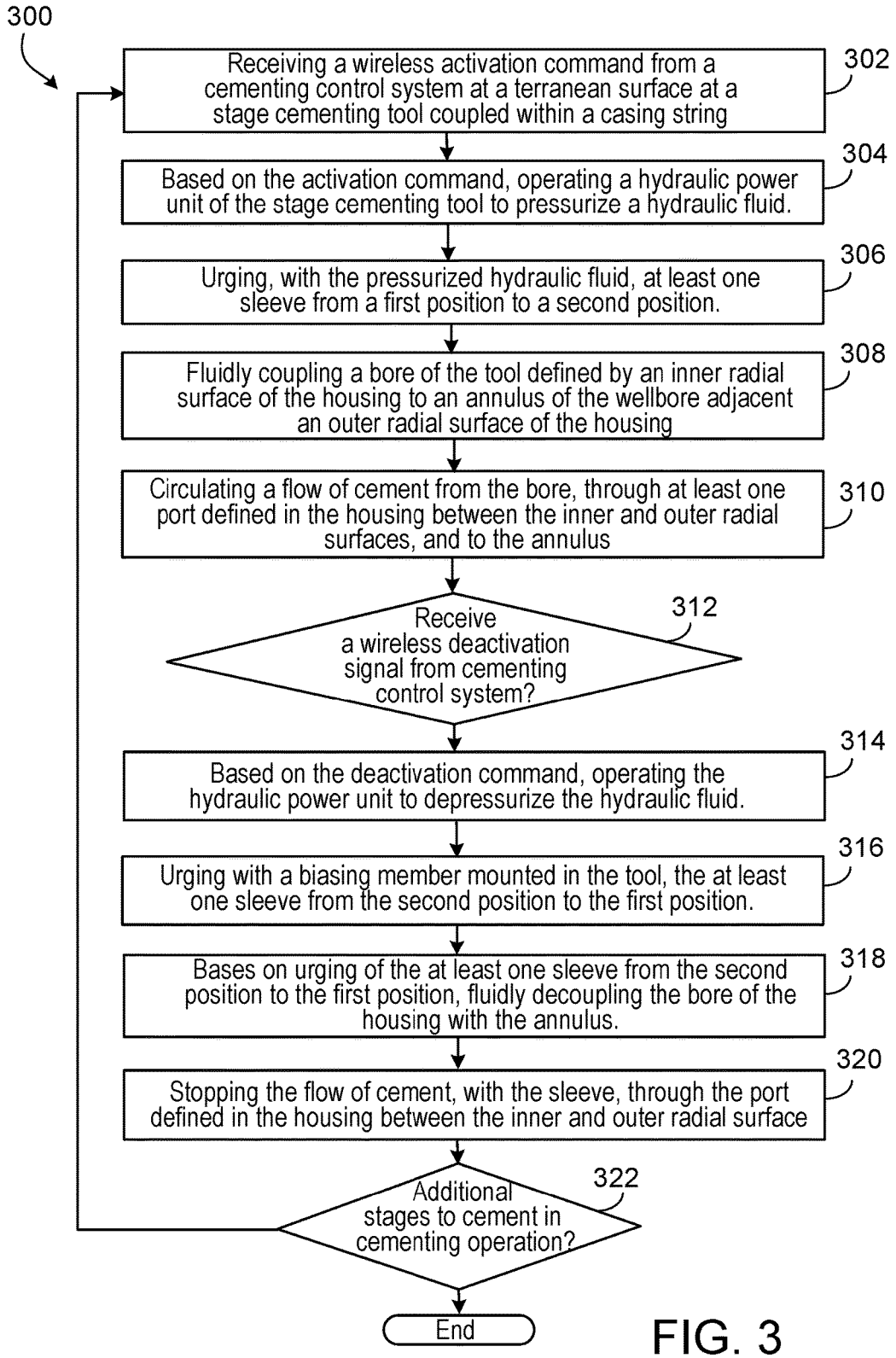
FIG. 3 is a flowchart that illustrates an example stage cementing method according to the present disclosure.

FIG. 3 is a flowchart that illustrates an example stage cementing method 300. In some aspects, the method 300 may be performed by or with the stage cementing tool 200 shown in FIGS. 2A-2C. Alternatively, the method 300 may be performed by another stage cementing tool according to the present disclosure. In some aspects, all or part of the method 300 may be repeated for multiple stages of a cementing operation.

Method 300 may begin at step 302, which includes receiving a wireless activation command from a cementing control system at a terranean surface at a stage cementing tool coupled within a casing string in a wellbore. For example, in some aspects, the cementing control system located on the terranean surface (e.g., at the wellsite) sends a wireless (e.g., Wi-Fi, electromagnetic, or otherwise) signal to one of multiple stage cementing tools that are coupled (e.g., threadingly) within a production casing in the wellbore. The stage cementing tools can be positioned at specified intervals (e.g., specified depths) in the wellbore to complete a stage cementing processing.

Method 300 may begin at step 304, which includes operating a hydraulic power unit (e.g., powered by a battery in the tool) of the stage cementing tool to pressurize a hydraulic fluid based on the activation command. For example, in some aspects, a controller of the tool, which receives the activation signal, activates a pump of the hydraulic power unit to pressurize a volume of a hydraulic fluid stored in a reservoir in the tool. In some aspects, after or with activation of the pump, the controller may also open a valve that fluidly couples the reservoir with another cavity or void in a housing of the tool.

Method 300 may begin at step 306, which includes urging, with the pressurized hydraulic fluid, at least one sleeve from a first position (e.g., closed) to a second position (e.g., open). For example, in some aspects, as the pressurized fluid flows into the cavity or void, which contains the sleeve, the pressurized fluid urges the sleeve in a direction through the void in the housing. In some aspects, the sleeve is moved from a position in which it blocks a flow of cement from the production casing, through the tool, and into the annulus, into a position in which the flow of cement is allowed through the tool (e.g., FIG. 2B).

Method 300 may begin at step 308, which includes fluidly coupling a bore of the tool defined by an inner radial surface of the housing to the annulus of the wellbore adjacent an outer radial surface of the housing. For example, in some aspects, as the sleeve moves into a position in which the flow of cement is allowed, the bore of the tool, which aligns with a bore of the production casing, is fluidly connected to the annulus.

Method 300 may begin at step 310, which includes circulating a flow of cement from the bore, through at least one port defined in the housing between the inner and outer radial surfaces, and to the annulus. For example, in some aspects, the tool includes a port that is opened when the sleeve moves from a closed state, by the pressurized fluid, to an open state. The port, which extends radially through a housing of the tool, includes a fluid pathway from the bore of the tool to the annulus when the sleeve is in the open position. In some aspects, the stage cementing tool may include multiple (e.g., 2, 3, 4, 5, or more) ports, arranged radially on the housing of the tool. Thus, in some aspects, steps 306-310 may be performed simultaneously or substantially simultaneously for multiple ports to open the tool to allow cement to flow into the annulus.

Method 300 may begin at step 312, which includes a determination of whether a wireless deactivation signal has been received at the stage cementing tool from the cementing control system. For example, in some aspects, e.g., based on a volumetric amount of cement that has been circulated to the annulus in step 310, the cementing control system may wirelessly send a deactivation signal to the particular stage cementing tool. If the wireless deactivation signal is received by the tool, then method 300 may continue at step 314. If not, then the method 300 may continue with step 308.

Method 300 may begin at step 314, which includes operating the hydraulic power unit to depressurize the hydraulic fluid based on the deactivation command. For example, in some aspects, based on the deactivation signal, the hydraulic power unit may signal the pump to stop pressurizing and circulating the hydraulic fluid into the cavity or void to urge the sleeve into an open position. The pressurized fluid may thus de-pressurize and at least begin to flow back into the hydraulic fluid reservoir from the cavity. The fluid pressure force on the sleeve, urging it into the open position, may therefore decrease or be removed.

Method 300 may begin at step 316, which includes urging, with a biasing member mounted in the tool, the at least one sleeve from the second position to the first position. For example, in some aspects, a spring or other biasing member (e.g., Bellville washers) may be positioned at an end of the sleeve opposite the pressurized fluid. The spring has a spring force associated with it that is exerted on the sleeve. When the fluid is pressurized, e.g., by the pump, the force of the pressurized fluid may be greater than the spring force, thereby urging the sleeve (and maintaining the sleeve) into the open position. As the pressurized fluid is depressurized and the fluid force is relieved on the sleeve, the spring force may be greater than the fluid force. The spring, therefore, may urge the sleeve back into the closed position.

Method 300 may begin at step 318, which includes based on urging of the at least one sleeve from the second position to the first position, fluidly decoupling the bore of the housing with the annulus. For example, in some aspects, when the sleeve is moved into the closed position (e.g., FIG. 2C), the bore of the tool is fluidly decoupled from the annulus. In other words, the port or ports of the tool are closed to not allow a flow of the cement through the stage cementing tool.

Method 300 may begin at step 320, which includes stopping the flow of cement, with the sleeve, through the port defined in the housing between the inner and outer radial surfaces. For example, in some aspects, once the ports are closed, the tool may be closed to any further flow of cement from the production casing to the annulus.

Method 300 may begin at step 322, which includes a determination of whether there are additional stages (e.g., of the annulus) to cement in the cementing operation. For example, in some aspects, there may be several stage cementing tools coupled within a production casing. The tools may be positioned at intervals, or depths, of the casing so that cement may be circulated through each, in turn, to insert the cement in the annulus at or between particular depths of the wellbore. In some aspects, the deepest stage cementing tool in the wellbore is first activated to facilitate a flow of cement into the annulus, and then deactivated. And then a next deepest stage cementing tool is activated and so on and until the shallowest (e.g., relative to TMD of the wellbore) stage cementing tool is activated. In step 322, if there is at least one stage cementing tool in the production casing which has not been activated, or if a previously-activated stage cementing tool needs to be re-activated, then method 300 may repeat back at step 302 and continue. If, however, no further stage cementing tools in the casing string need be activated, then method 300 may stop and the stage cementing process may be completed.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A stage cementing tool, comprising:

a top sub-assembly configured to couple to a portion of a casing string;

a bottom sub-assembly configured to couple to another portion of the casing string;

a housing that connects the top and bottom sub-assembly and comprises a bore therethrough from the top sub-assembly to the bottom sub-assembly, the housing comprising a plurality of ports radially arranged in the housing, each port comprising a fluid path between an interior radial surface of the housing and an outer radial surface of the housing;

at least one sleeve that rides on a portion of the housing, the at least one sleeve comprising a plurality of sleeves, each sleeve associated with one of the plurality of ports;

a controller mounted in the housing and configured to control the sleeve to adjust, based on receipt of a command to the controller from the terranean surface, between a first position such that the sleeve mandrel decouples fluid communication from the bore to an exterior of the housing through the fluid paths and a second position such that the sleeve mandrel fluidly couples the bore with the exterior of the housing through the fluid paths; and a hydraulic power unit communicably coupled to the controller and configured to adjust the sleeve between the first and second positions, the hydraulic power unit comprising:

a plurality of hydraulic fluid cavities, each cavity aligned with one of the plurality of ports and at least partially filled with a hydraulic fluid; and at least one pump fluidly coupled to the hydraulic fluid cavities to circulate the hydraulic fluid in each hydraulic fluid cavity against a respective sleeve.

2. The stage cementing tool of claim 1, wherein the controller is communicably coupled to the pump and operable to activate the pump to circulate the hydraulic fluid into a plurality of slots and against the plurality of sleeves to move the sleeves on the housing within respective slots to align a bore of each sleeve with the port in the second position.

3. The stage cementing tool of claim 2, further comprising a plurality of biasing members, each biasing member mounted in the housing adjacent a respective sleeve.

4. The stage cementing tool of claim 3, wherein the controller is communicably coupled to the pump and operable to deactivate the pump to allow the hydraulic fluid to flow into the hydraulic fluid cavities, and each biasing member is configured to urge the respective sleeve on the housing to misalign the bore of each sleeve with the port in the first position.

5. The stage cementing tool of claim 4, wherein the controller comprises a wireless transceiver configured to communicate with a stage cementing control system at the terranean surface.

6. The stage cementing tool of claim 2, further comprising a plurality of valves, each valve fluidly coupled between a respective hydraulic fluid cavity and a respective slot.

7. The stage cementing tool of claim 1, further comprising at least one pressure sensor mounted in the housing to detect a fluid pressure of the hydraulic fluid, the at least one pressure sensor communicably coupled to the controller.

8. The stage cementing tool of claim 1, wherein the controller comprises a wireless transceiver configured to communicate with a stage cementing control system at the terranean surface.

9. A method for cementing a casing in a wellbore, comprising:

receiving, at a stage cementing tool coupled within a casing string in a wellbore, a wireless command from a stage cementing control system at a terranean surface;

based on the wireless command, operating a hydraulic power unit mounted in a housing of the stage cementing tool to pressurize a hydraulic fluid stored in a hydraulic fluid cavity of the housing;

urging, with the pressurized hydraulic fluid, at least one sleeve positioned to ride on a portion of the housing from a first position to a second position;

based on urging of the at least one sleeve from the first position to the second position, fluidly coupling a bore of the housing defined by an inner radial surface of the housing to an annulus of the wellbore adjacent an outer radial surface of the housing; and circulating a flow of cement from the bore, through at least one port defined in the housing between the inner and outer radial surfaces, and to the annulus.

10. The method of claim 9, further comprising:

receiving, at the stage cementing tool, another wireless command from the stage cementing control system at the terranean surface;

based on the other wireless command, operating the hydraulic power unit to depressurize the hydraulic fluid;

urging, with a biasing member mounted in the housing, the at least one sleeve from the second position to the first position;

based on urging of the at least one sleeve from the second position to the first position, fluidly decoupling the bore of the housing with the annulus; and stopping the flow of cement, with the sleeve, through the port defined in the housing between the inner and outer radial surfaces.

11. The method of claim 10, wherein operating the hydraulic power unit to depressurize the hydraulic fluid comprises:

deactivating at least one pump in fluid communication with the hydraulic fluid cavity; an allowing the pressurized hydraulic fluid to flow back into the hydraulic fluid cavity.

12. The method of claim 10, wherein the stage cementing tool comprises a first stage cementing tool, the method further comprising, subsequent to stopping the flow of cement with the sleeve through the port defined in the housing between the inner and outer radial surfaces:

receiving, at a second stage cementing tool coupled within the casing string in the wellbore, another wireless command from the stage cementing control system at the terranean surface;

based on the other wireless command, operating a hydraulic power unit mounted in a housing of the second stage cementing tool to pressurize a hydraulic fluid stored in a hydraulic fluid cavity of the housing;

urging, with the pressurized hydraulic fluid, at least one sleeve positioned to ride on a portion of the housing from a first position to a second position;

based on urging of the at least one sleeve from the first position to the second position, fluidly coupling a bore of the housing defined by an inner radial surface of the housing to the annulus of the wellbore adjacent an outer radial surface of the housing; and circulating another flow of cement from the bore, through at least one port defined in the housing between the inner and outer radial surfaces, and to the annulus.

13. The method of claim 9, wherein the at least one sleeve comprises a plurality of sleeves, each sleeve associated with one of a plurality of ports.

14. The method of claim 13, further comprising:

operating the hydraulic power unit to pressurize the hydraulic fluid stored in a plurality of hydraulic fluid cavities of the housing;

urging, with the pressurized hydraulic fluid in each hydraulic fluid cavity, a respective sleeve of the plurality of sleeves from the first position to the second position; and based on urging each of the sleeves from the first position to the second position, fluidly coupling the bore of the housing to the annulus of the wellbore adjacent the outer radial surface of the housing through a respective port of a plurality of ports in the housing.

15. The method of claim 14, wherein operating the hydraulic power unit to pressurize the hydraulic fluid stored in the plurality of hydraulic fluid cavities of the housing comprises:

operating at least one pump to pressurize the hydraulic fluid in the plurality of hydraulic fluid cavities; and circulating the pressurized hydraulic fluid into a plurality of slots and against the plurality of sleeves to move the sleeves on the housing within respective slots to align a bore of each sleeve with the port to adjust the sleeves to the second position.

16. The method of claim 9, further comprising:

wirelessly transmitting, from the stage cementing tool to the stage cementing control system, data associated with operation of the stage cementing tool to the stage cementing control system, the data comprising at least one of a power status of the stage cementing tool, a sensed pressure of the hydraulic fluid, or an electronic status of the stage cementing tool.

17. The method of claim 9, further comprising:

supplying power to at least one of a controller or the power unit of the stage cementing tool with a battery mounted in the housing.

18. A stage cementing system, comprising:

a stage cementing control system positioned on a terranean surface and configured for wireless communication; and a first stage cementing tool configured to couple within a production casing string in a wellbore, the first stage cementing tool comprising:

a housing that comprises a bore therethrough;

a plurality of ports radially about the housing, each port comprising a flow path between the bore and an outer radial surface of the housing;

a plurality of sleeve mandrels, each sleeve mandrel positioned to ride the housing to orthogonally intersect a respective port of the plurality of ports; and a controller mounted in the housing and configured for wireless communication with the stage cementing control system, the controller configured to perform operations comprising:

receiving a first wireless signal from the stage cementing control system; and based on the first wireless signal, operating a hydraulic power unit of the first stage cementing tool to circulate a pressurized fluid against the sleeve mandrels to urge each of the sleeve mandrels into a clearance position out of a respective port of the plurality of ports to fluidly couple the bore with an annulus of the wellbore during a first cementing operation.

19. The stage cementing system of claim 18, wherein the controller is further configured to perform operations comprising:

receiving a second wireless signal from the cementing control system; and based on the second wireless signal, operating the hydraulic power unit to depressurize the pressurized fluid against the sleeve mandrels.

20. The stage cementing system of claim 19, wherein the stage cementing tool further comprises a plurality of springs, each spring positioned to urge a respective sleeve mandrel in a direction opposite a flow of the pressurized fluid to fluidly decouple the bore with the annulus of the wellbore during the first cementing operation.

21. The stage cementing system of claim 20, further comprising:

a second stage cementing tool configured to couple within the production casing string in the wellbore, the second stage cementing tool comprising:

a housing that comprises a bore therethrough;

a plurality of ports radially about the housing, each port comprising a flow path between the bore and an outer radial surface of the housing;

a plurality of sleeve mandrels, each sleeve mandrel positioned to ride the housing to orthogonally intersect a respective port of the plurality of ports; and a controller mounted in the housing and configured for wireless communication with the stage cementing control system, the controller configured to perform operations comprising:

receiving a third wireless signal from the stage cementing control system; and based on the third wireless signal, operating a hydraulic power unit of the second stage cementing tool to circulate a pressurized fluid against the sleeve mandrels to urge each of the sleeve mandrels into a clearance position out of a respective port of the plurality of ports to fluidly couple the bore with the annulus of the wellbore during a second cementing operation.

22. The stage cementing system of claim 18, further comprising:

a second stage cementing tool configured to couple within the production casing string in the wellbore, the second stage cementing tool comprising:

a housing that comprises a bore therethrough;

a plurality of ports radially about the housing, each port comprising a flow path between the bore and an outer radial surface of the housing;

a plurality of sleeve mandrels, each sleeve mandrel positioned to ride the housing to orthogonally intersect a respective port of the plurality of ports; and a controller mounted in the housing and configured for wireless communication with the stage cementing control system, the controller configured to perform operations comprising:

receiving a third wireless signal from the stage cementing control system; and based on the third wireless signal, operating a hydraulic power unit of the second stage cementing tool to circulate a pressurized fluid against the sleeve mandrels to urge each of the sleeve mandrels into a clearance position out of a respective port of the plurality of ports to fluidly couple the bore with the annulus of the wellbore during a second cementing operation.

* * * * *